US007766804B2

(12) United States Patent
Placencia

(10) Patent No.: US 7,766,804 B2
(45) Date of Patent: Aug. 3, 2010

(54) ABDOMINAL EXERCISER AND METHOD

(76) Inventor: David Placencia, 15906 4th Ave. South #23, Burien, WA (US) 98148

( * ) Notice: Subject to any disclaimer, the term of this patent is extended or adjusted under 35 U.S.C. 154(b) by 0 days.

(21) Appl. No.: 12/456,056

(22) Filed: Jun. 11, 2009

(65) Prior Publication Data

US 2009/0312164 A1 Dec. 17, 2009

Related U.S. Application Data

(60) Provisional application No. 61/060,782, filed on Jun. 11, 2008.

(51) Int. Cl.
*A63B 21/00* (2006.01)

(52) U.S. Cl. ..... 482/121; 482/124

(58) Field of Classification Search ..... 482/121, 482/126, 129, 111, 112, 130, 72, 907, 122, 482/123
See application file for complete search history.

(56) References Cited

U.S. PATENT DOCUMENTS 4,428,578 A * 1/1984 Kirkpatrick ..... 482/129
4,517,966 A * 5/1985 von Othegraven ..... 482/122
5,372,558 A * 12/1994 Perry et al. ..... 482/49
5,860,897 A * 1/1999 Gilbert et al. ..... 482/130
6,290,630 B1 * 9/2001 Boland ..... 482/130
7,470,221 B1 * 12/2008 Ramos ..... 482/100
2006/0014614 A1 * 1/2006 Szabo et al. ..... 482/140

* cited by examiner

*Primary Examiner*—Jerome Donnelly
(74) *Attorney, Agent, or Firm*—Polly L. Oliver

(57) ABSTRACT

An abdominal exerciser can be used while standing up. The user stands on the anchor base and rests the neckpad on his shoulders while gripping the handlebars. The user can then bend forward and backward to strengthen the abdominal and lower back muscles or side-to-side to strengthen the obliques. The unit is adjustable to fit various sizes of users and/or styles of workouts and can be partially disassembled for easy transportation. The unit comprises an elongate stem/tail assembly, a handlebar assembly including the neckpad to attach at the upper end, and an anchor base to attach at the bottom end. Resistance bands removably attached to hooks between the anchor base and the stem/tail assembly provide variable resistance to the user.

16 Claims, 10 Drawing Sheets

ABDOMINAL EXERCISER AND METHOD

RELATED APPLICATIONS

This application is related to and claims priority under 35 U.S.C. 119(e) to U.S. provisional application Ser. No. 61/060,782, entitled "Abdominal Exerciser," filed on Jun. 11, 2008, with inventor David Placencia, which is hereby incorporated by reference in its entirety.

FIELD OF THE INVENTION

This invention pertains generally to exercise equipment and more particularly to a stand-alone piece of equipment for exercising the abdominal, oblique, and lower back muscles.

BACKGROUND OF THE FIELD

There is a limited choice of exercise equipment on the market today for exercising and strengthening the body's core muscles, including abdominals, obliques, and lower back muscles. Many of these equipment choices require that the user sit or lie down—putting pressure on the user's spine and coccyx. If the user must lie down in a prone position, typically the knees and/or thighs are engaged. In addition, many of these equipment choices are stationary, such as sit-up chairs and crunching machines, and are therefore not easily portable.

Many people who exercise regularly prefer to divide their exercise time between the various large groups of muscles in the body in order to focus their efforts for optimum results. For instance, during one training session, they will exercise the arms and upper body, during another training session, they will exercise the legs and lower body, and during even another training session they will exercise the abdominals and back muscles. Therefore, when exercising the abdominals, it is desirable to also be able to include the obliques, lower back, and other proximate muscles for a focused training session.

Furthermore, a portable piece of equipment is often sought. Many people do not want to have to search out a new gym whenever they travel, but at the same time do not want to forgo their regular exercise routine. Because most abdominal exercisers of the type found in gyms are fixed to the floor and/or use extensive frames to provide resistance, they are not conducive to travel. As a stop-gap solution, many people think to rely on exercise bands of the type that can be attached temporarily to doorknobs or doorframes or that can be stood on to be made stationary. A problem with these exercise bands is that they do not offer much stability and are difficult to control.

SUMMARY OF THE INVENTION

The present invention solves the above-mentioned problems by providing a portable piece of equipment that can be used while standing. This invention is small and lightweight enough to be stowed and carried by the smallest adult users, yet strong and durable enough to be used by the largest adult users. The invention of the abdominal exerciser enables a user to perform a variety of abdominal crunch-like movements to exercise and condition the abdominal, oblique, and lower back or "core" muscles while standing up as opposed to sitting down or lying as other devices require a person to do. In addition to alleviating pressure on the spine and coccyx, standing can ensure that the knees and thighs are not engaged, but that the exercise focuses on the muscles of interest.

The invention may comprise an elongate stem/tail assembly which links a neck pad and handlebar assembly to an anchor base using resistance bands. The design of the exerciser makes use of the user's weight while standing on the anchor base to hold the equipment in place and does not require any fastening to wall or floor. Both the height of the overall assembled exerciser and the arm positions of the handlebars may be adjustable to fit a wide variety of users. Moreover, the resistance may be made adjustable by changing resistance bands or even using two or more bands together at the same time. The folding handlebar assembly allows for enhanced portability and storage of the device.

Two versions of the abdominal exerciser are offered herein—a preferred embodiment that is ergonomically designed and takes advantage of enhanced manufacturing materials and techniques and an alternate embodiment that can be built more simply and inexpensively but that nevertheless offers the same exercising benefits. Both versions can provide the user with a comprehensive abdominal workout including obliques and lower back muscles. Both versions offer adjustability (typically at the handlebar assembly and the tail extension) so that the user can adjust the exerciser to fit his or her individual size, style, and exercise requirements, and can offer additional comfort through the use of hand grips on the handlebars. Furthermore, in both versions, the user can swap resistance bands or even use more than one resistance band at a time to further customize his or her workout. It is understood that although these two versions are represented here on paper, other embodiments of the inventive concept can be built which will also be covered by these claims.

BRIEF DESCRIPTION OF THE DRAWINGS

The objects, features, and advantages of the present invention will be apparent to one skilled in the art from reading the following description in which.

DETAILED DESCRIPTION

The following specification describes an abdominal exerciser apparatus and method for using. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

Figure 1:
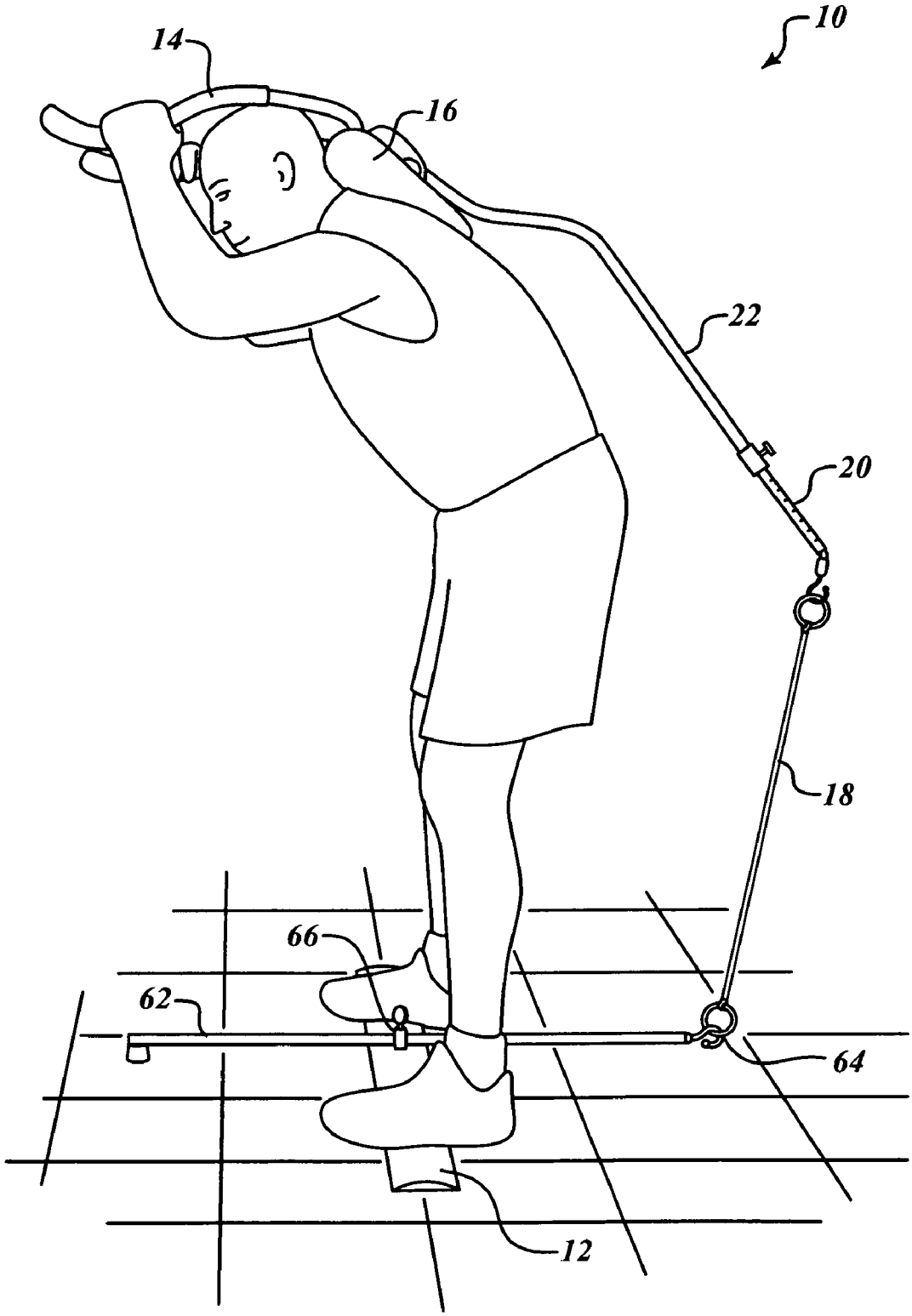
FIG. 1 is a perspective view of a person using the abdominal exerciser.

FIG. 1 shows a person using the abdominal exerciser 10 to condition (or strengthen) his abdominal muscles. He is standing upright with his feet on the anchor base 12 and his hands gripping the handlebars 14 (which in this illustration are fitted with hand grips for comfort and control), the neck pad 16 resting on his shoulders and upper back. The elongate stem member 22 defines an attachment area at its top/upper end where the handlebar assembly is to be adjustably attached and the neck pad is also to be attached. (The term "handlebar assembly" will be used throughout this description instead of "handlebar"; however, the reader understands that the handlebar assembly may be made by various manufacturing methods as one piece) In this exercise shown, the user is bending forward to strengthen his abdominal muscles. In the interest of space, other specific exercises are not shown; however, the reader understands that the user of this equipment could bend in several different ways to maximize the variety of strengthening and toning exercises. For instance, the user can bend forward to condition (or strengthen) the abdominal muscles and then slowly resist the pull of the resistance band(s) while returning to the upright position to condition (or strengthen) the lower back muscles. The user can also bend or twist his or her torso to the left or right while bending forward to condition (or strengthen) the oblique muscles. Resistance to the user is provided by the resistance band(s) 18 attached between the anchor base 12 and the tail extension 20, which in turn slides up into the stem 22 and is stopped at a user-prescribed point by a stop at the lower end of the stem. The tail extension 20 defines a hook at its bottom end where the resistance bands (at least one) are to be attached. In this illustration, a cross member 62 (further described below) extends generally orthogonally from the anchor base in order to further space the resistance band(s) 18 from the user.

Figure 1A:
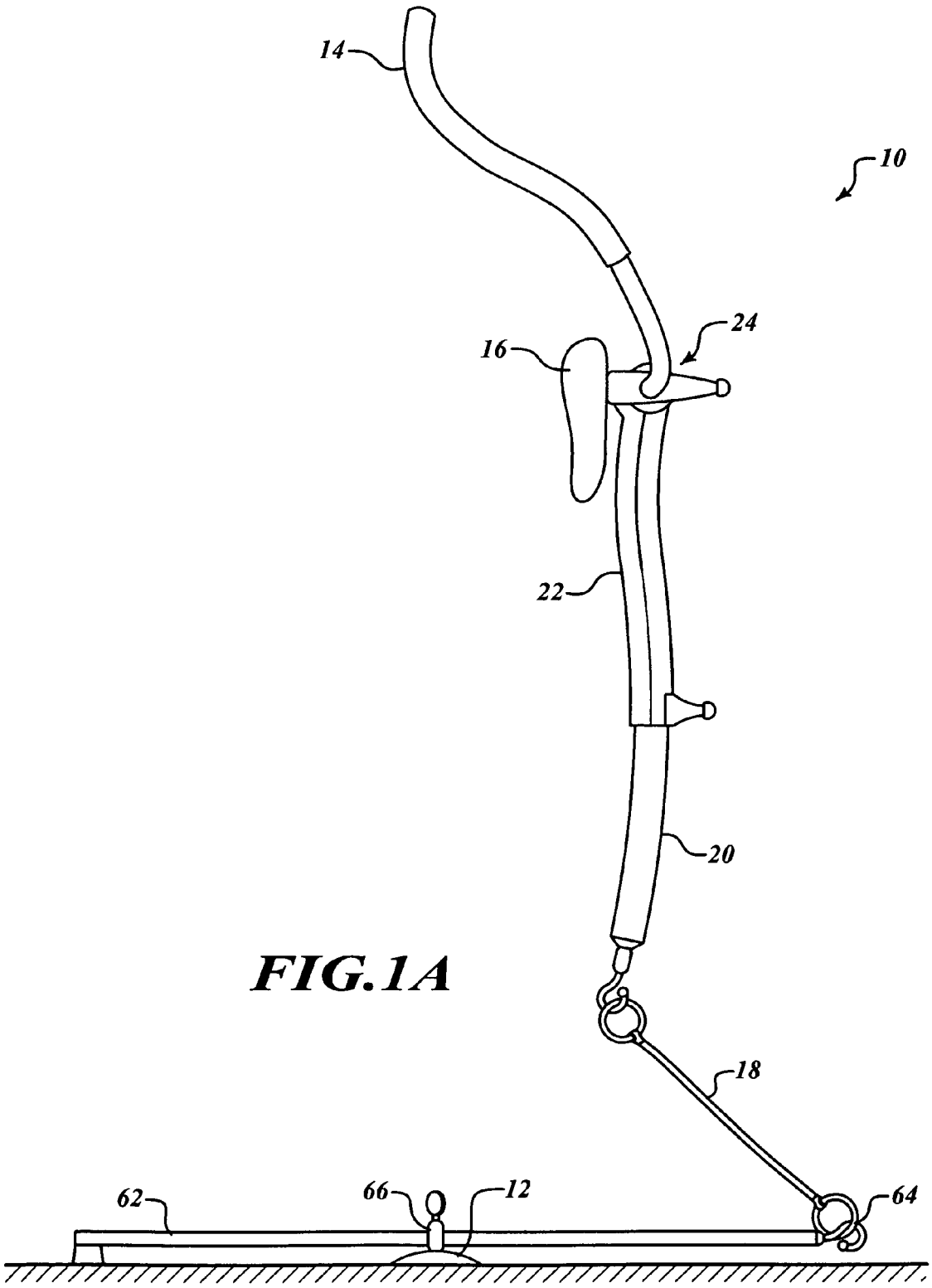
FIG. 1A is a side view of a preferred embodiment of the abdominal exerciser.
Figure 1B:
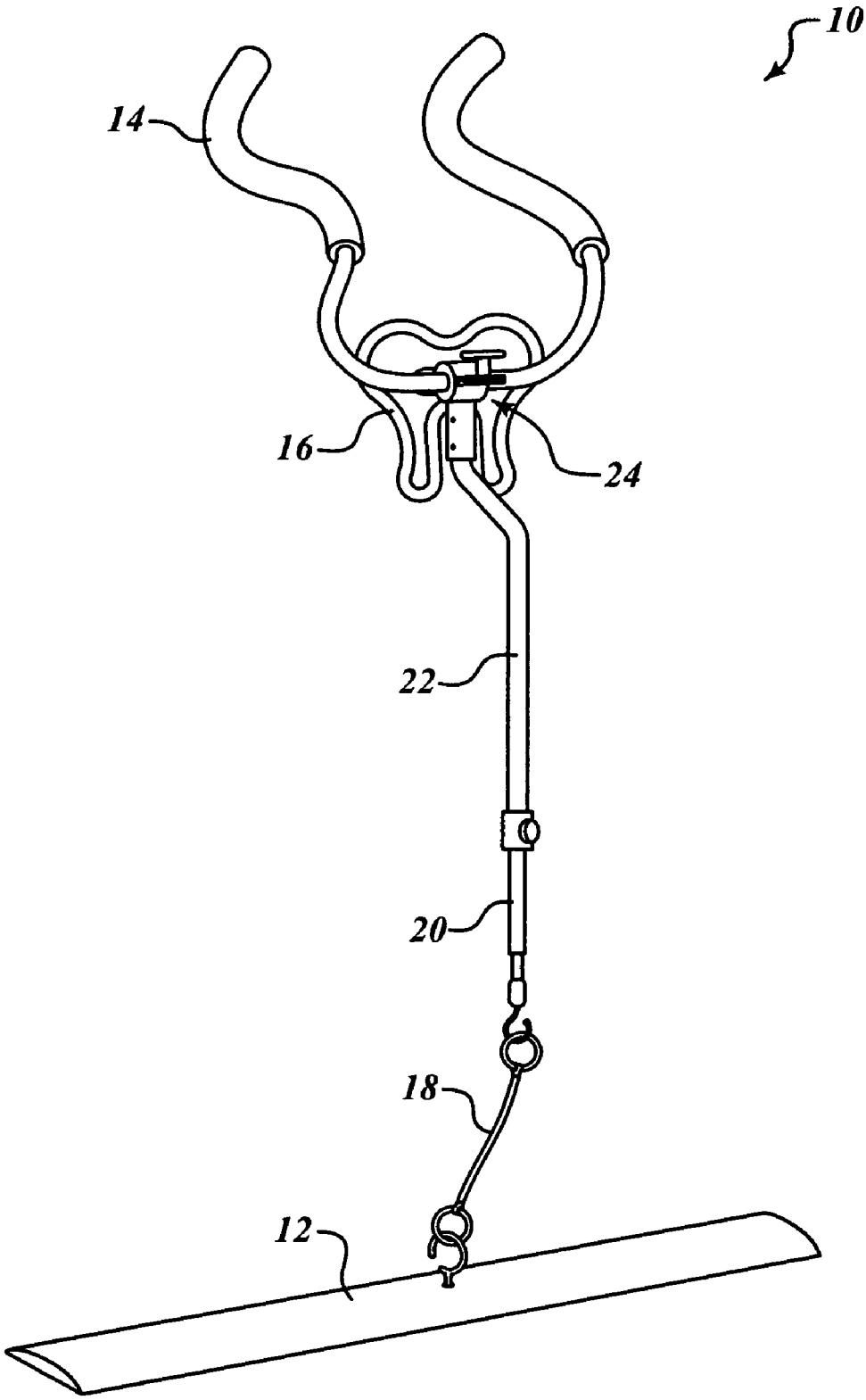
FIG. 1B is a perspective view of an alternate embodiment of the abdominal exerciser.

FIG. 1A shows the abdominal exerciser 10 as it may be embodied in a first version made from high-strength, durable plastic, composite, or other suitable material. This version presents an ergonomically curved stem 22 to direct the tail extension 20 away from the user's body. The tail extension 20 slides up into the hollow stem so that the user can shorten or lengthen the entire assembly to account for the user's height and comfort level. This stem/tail assembly may be of two pieces—one nested into the other as described, or it may be of one-piece construction—having the tail portion extendable from the elongate stem member. FIG. 1B shows an alternate embodiment that may be produced more inexpensively, using more conventional tubing for the stem 22 (a generally elongate hollow cylinder having an upper end and a lower end) and a simpler connection at the upper connector 24 in proximity to the neck pad 16. This figure shows the neck pad and handlebar assembly attached to the top/upper end of the stem, the tail extension slidably attached at the lower end of the stem, and the resistance bands attached to the bottom end of the tail extension. Regardless of the stem/tail design, there will be an attachment area at the top/upper end of the elongate member/portion for the neck pad and handlebars/handlebar assembly, and a hook at the bottom end of the extendable portion for the resistance band(s) and anchor base.

Figure 2A:
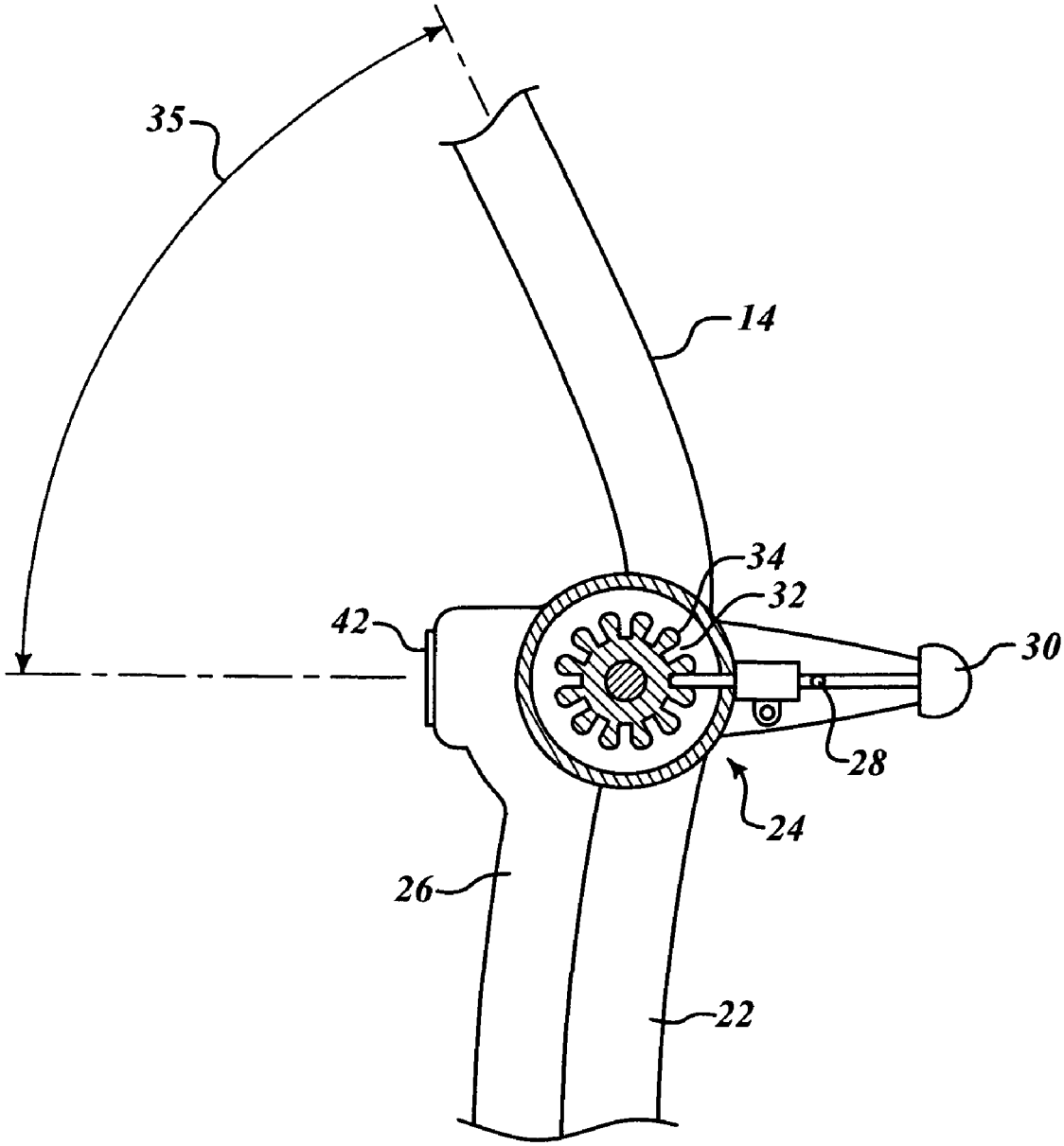
FIG. 2A is a side cutaway view of the handlebar assembly of the preferred embodiment in FIG. 1A.

FIG. 2A is a side cutaway view of the handlebar adjustment and the upper connector 24 of the first embodiment. The handlebars 14 are preferably contoured to fit the user's stance and grip and may be fixed to the stem or adjustably attached through the upper connector 24, which is fixed either to the upper end 26 of the stem 22 at the top attachment area or to the handlebar assembly 14 itself. In a preferred embodiment, the upper connector 24 may include a spring-loaded handlebar stop 28 with a finger pull 30 that is designed to fit selectively into stop slots 32 arranged around fixed disk 34. Such selection of the desired stop slot is similar to a ratchet and pawl or a spring and detent mechanism. Adjusting the handlebar assembly thus—relative to the stem member—changes the included angle 35 between the handlebars and the stem 22 and can be chosen so that the user will grip the handlebars closer to his chest or further above his head—in order to customize the exercise experience. There may be a left and a right disk 34 in order to allow the left and right handlebars 14 to be adjusted independently, or one disk as shown can adjust the entire handlebar assembly.

Figure 2B:
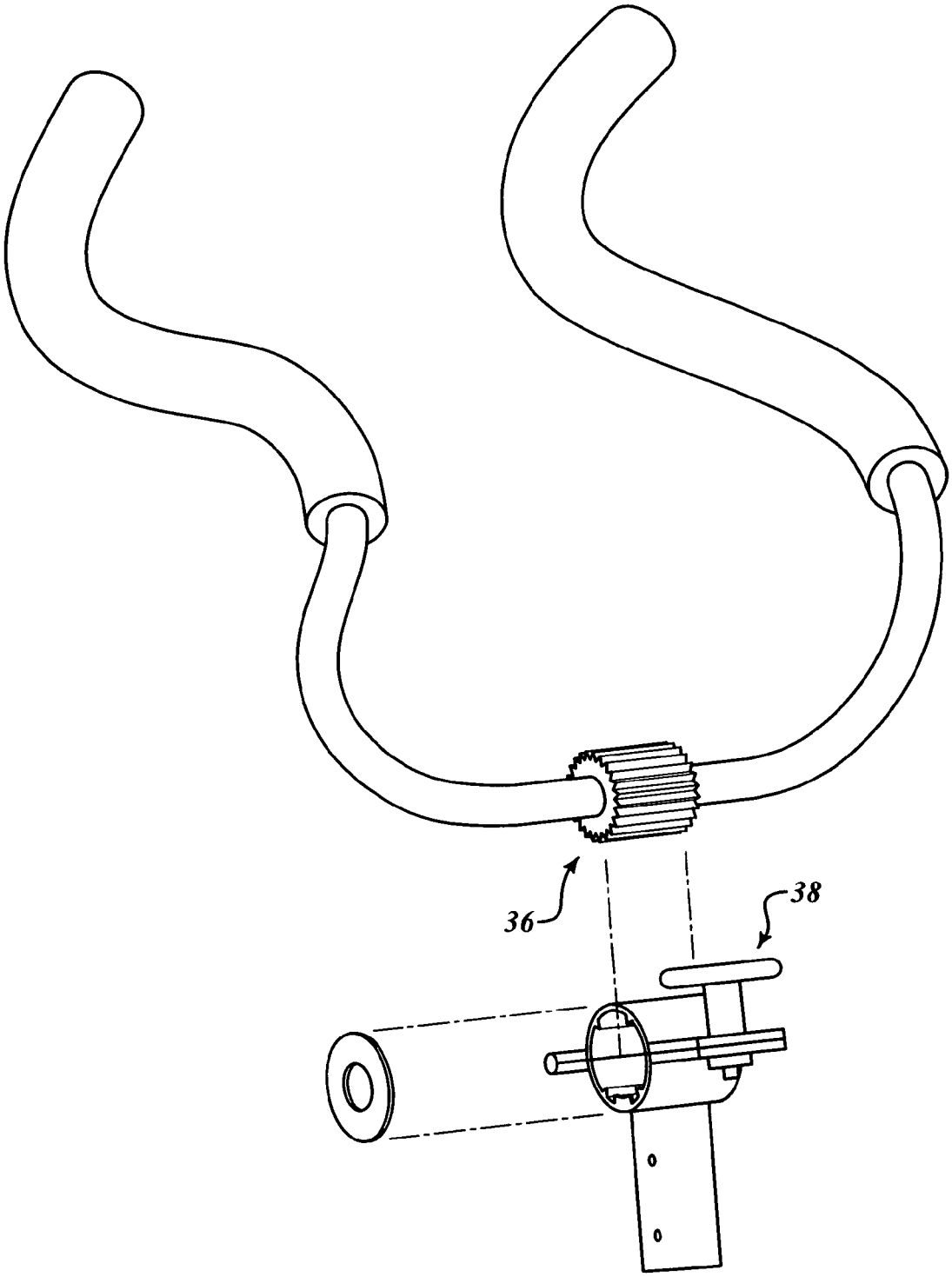
FIG. 2B is an exploded view of an alternate design of the handlebar assembly.

FIG. 2B is a detail exploded view of an alternate embodiment of the handlebar assembly 14 according to FIG. 1B which may comprise a gear tooth collar 36 within a clampdown assembly 38 fastened to the upper end 26 of the stem. Once again, this arrangement of elements allows that the equipment could be manufactured from more conventional parts. In this case, upon tightening of the clampdown assembly 38, the teeth inside the clampdown assembly 38 engage with the gear tooth collar 36 to prevent slippage. This method also accomplishes the goal of changing the included angle between handlebars and stem.

Figure 3A:
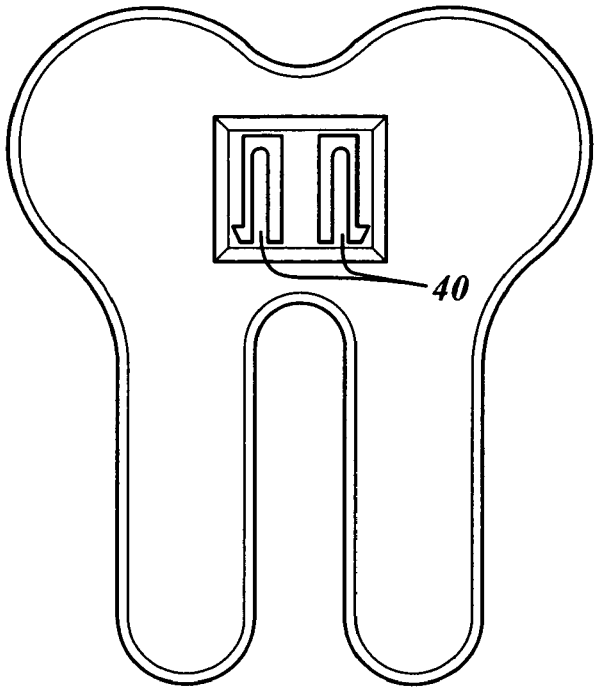
FIG. 3A is a rear view of the neck pad of the embodiment of FIG. 1A.

FIG. 3A shows a preferred embodiment of the neck pad 16 from the rear instead of from the side as in FIG. 1A, which is considered part of the handlebar assembly. Because the stem 22 itself is constrained only by the user's size and posture, it is not necessary for the neck pad 16 to be adjustable, and it simply attaches to the upper end 26 of the stem proximate the handlebar assembly 14. The attachment may be accomplished by sliding attachment slots 40 onto the mating prongs 42 (shown in FIG. 2A) provided on the upper connector 24 or even on the upper end 26 of the stem 22. Thus, the neck pad becomes part of the overall handlebar assembly.

Figure 3B:
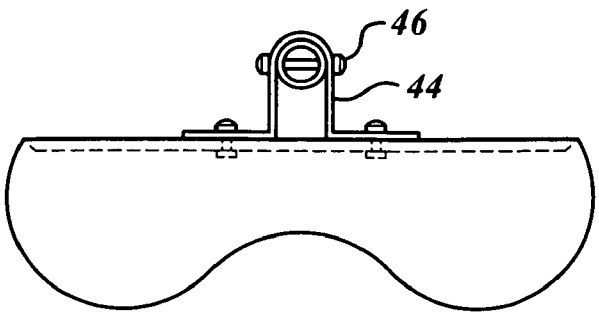
FIG. 3B is a top detail view of an alternate design of the neck pad.

FIG. 3B is a detail view of an alternate embodiment of the neck pad 16 according to FIG. 1B (as seen from the top) which may comprise an attachment brace 44 with pin 46 for attaching to the upper end of the stem. In this case, the stem 22 will need to have the appropriate holes for the pin 46. This method of attaching the neck pad will also be non-adjustable, as is the arrangement of FIG. 3A; however, it can be accomplished more conventionally. In either case, the neck pad 16 is large enough and offers enough cushioning to protect the user's neck and shoulders and to provide comfort while using the equipment. The neck pad also may comprise support plates between the connectors (prongs or brackets) and the cushion for stiffening.

Figure 4A:
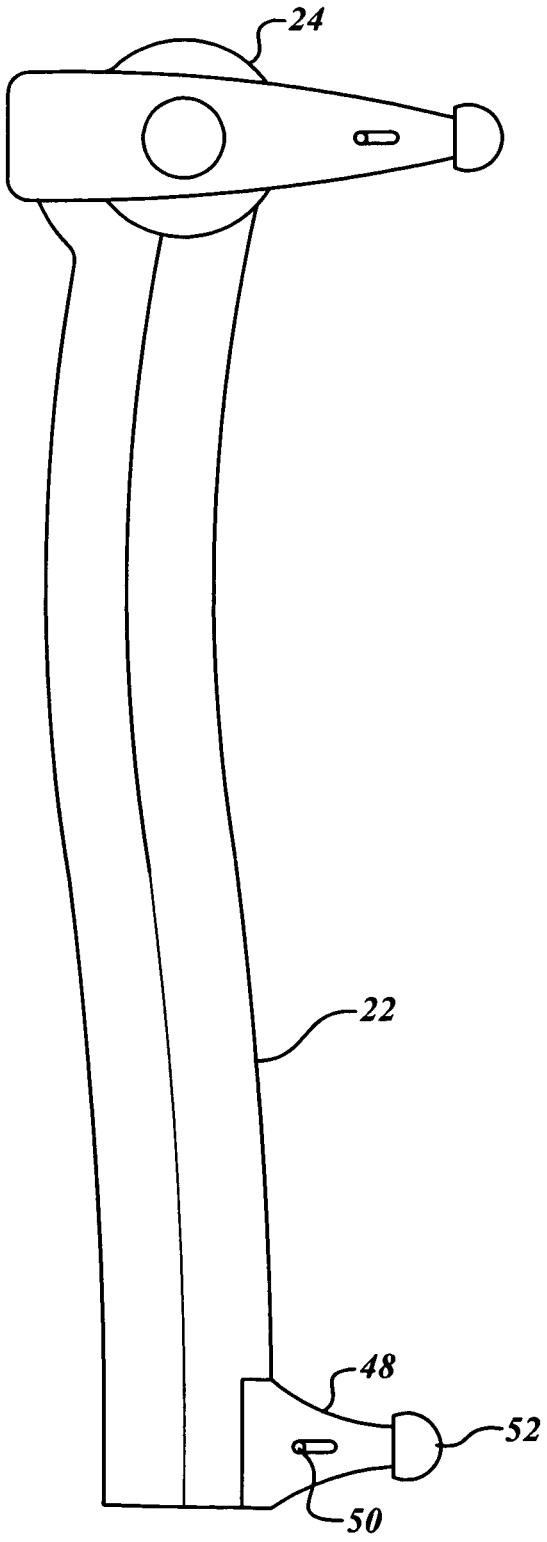
FIG. 4A is a side detail view of the stem and upper connector of the embodiment of FIG. 1A.

FIG. 4A shows how the stem 22 of the preferred embodiment may have the upper connector 24 mounted on the upper end 26 at the top attachment area. As described above, the upper connector 24 may house adjustable fastening means for the handlebar assembly 14 and the neck pad 16. The upper connector 24 may be provided in two halves so that one half may be removed to allow the handlebar assembly to break down for easier shipping, storage, and portability. The stem 22 is optimally curved as shown to provide a more ergonomic fit for the user, but can be alternately provided as a straighter design as shown in FIG. 1B. The stem should be at least partially hollow in order to slidably house the tail extension 20, and comprises a lower connector 48 to house a spring loaded tail stop 50 with finger pull 52 similar to the handlebar stop 28 and finger pull 30. The figures show how the tail extension 20 is adjustable relative to the stem so that the user may select the appropriate length of the overall assembly (to adjust for the user's height, etc.).

Figure 5A:
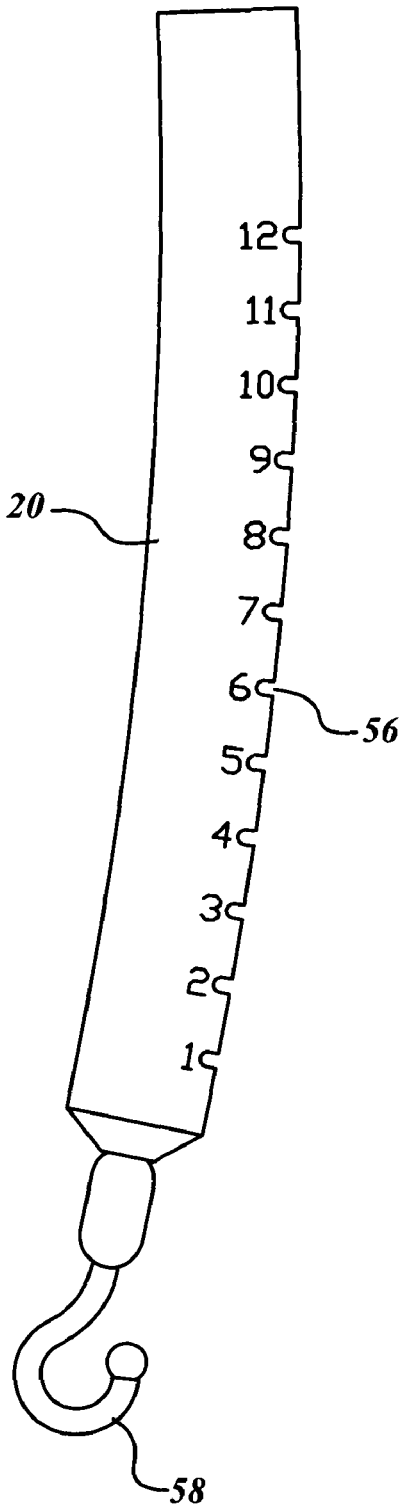
FIG. 5A is a side detail view of the tail extension of the FIG. 1A embodiment.
Figure 5B:
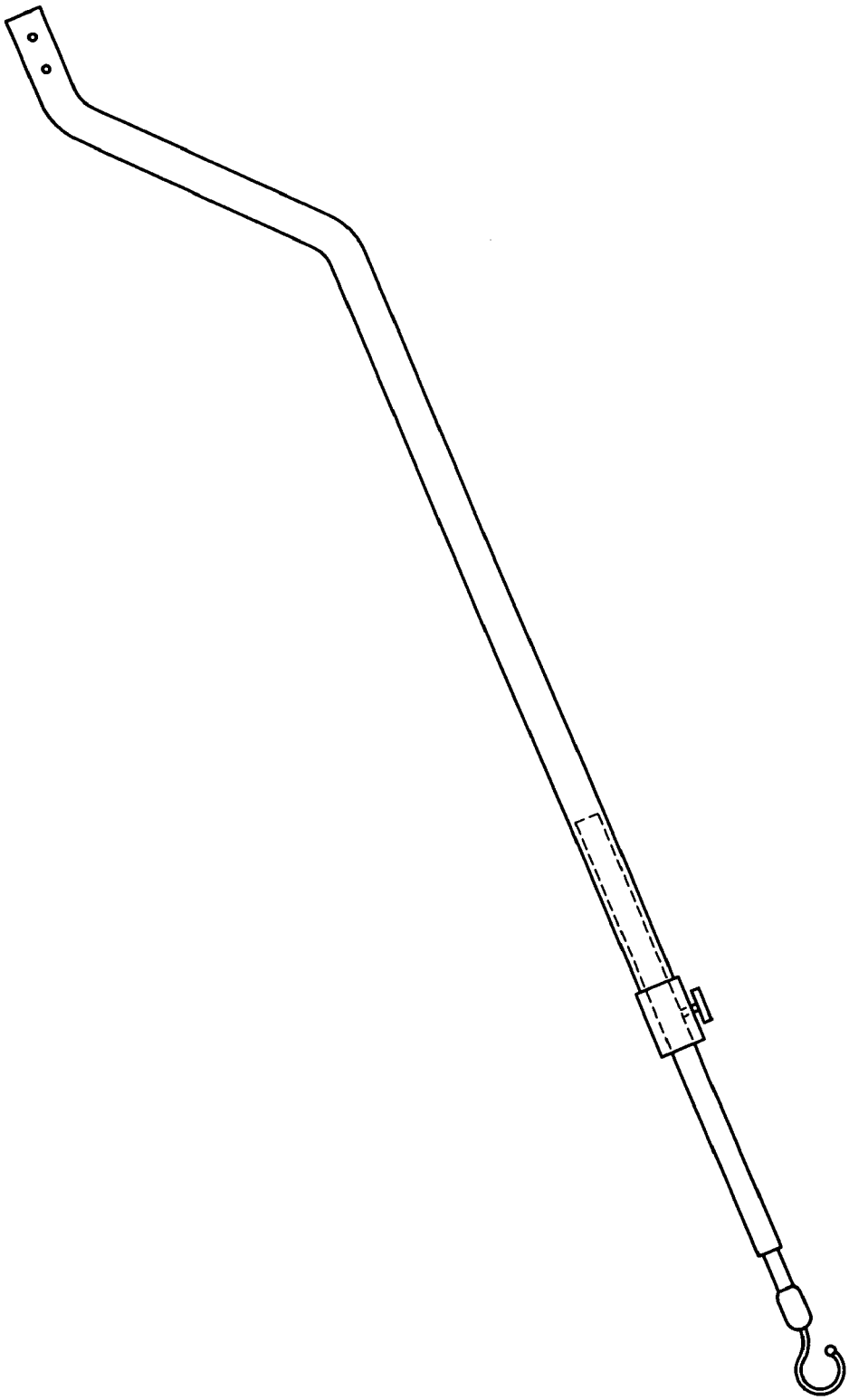
FIG. 5B is a detail view of an alternate design of the tail extension.

FIG. 5A shows how the tail extension 20 of the preferred embodiment defines stop slots 56 to cooperate with the finger pull 52 and stop 50 in order to adjust the overall length of the stem/tail assembly. A user may wish to adjust the length to accommodate his or her height or to provide more or less resistance in combination with the resistance band(s) 18. Hook 58 will be provided on the lower end of the tail extension, which itself may be straight as shown in FIG. 5B or somewhat curved as shown here. (Straight or curved, the tail extension may fit slidably within the hollow stem of the exerciser.) The stop slots 56 may be located at regular intervals along the tail extension 20, such as inches, and they may be marked with height indicators as shown. In the alternate embodiment shown in FIG. 5B, the adjustment of the tail extension relative to the stem may be accomplished simply with a collar and a pull pin as shown to selectively fasten the tail extension (which may be fitted with stop slots).

Figure 6:
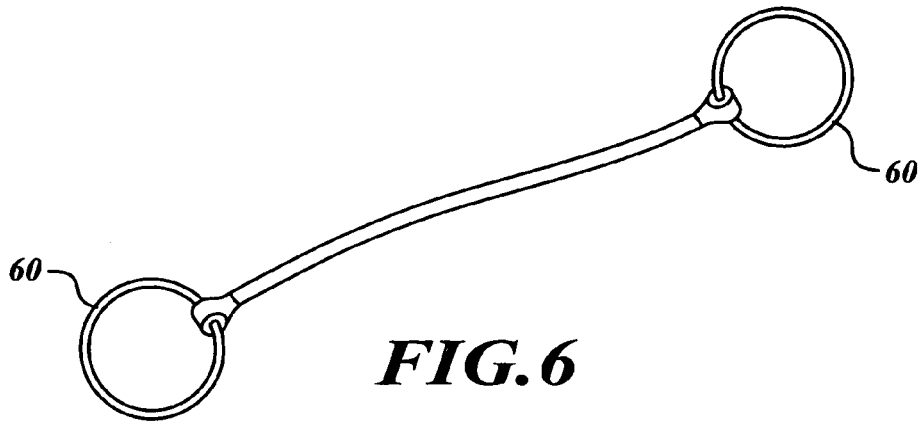
FIG. 6 is a detail view of a resistance band.

FIG. 6 shows a resistance band 18. Resistance bands are typically made from rubber or some other elastomeric material so that they will stretch but recover their original length when tension is removed, and can be made in differing thicknesses or from different materials to offer variable resistance at the same length. For this exerciser, the bands 18 may have an attachment ring 60 at either end to facilitate quick and secure attachment between the tail hook 58 and the anchor base 12. Several different size bands (e.g., diameter, length) may be provided with the exerciser, and the user may use one or more bands to customize his or her desired resistance level.

Figure 7A:
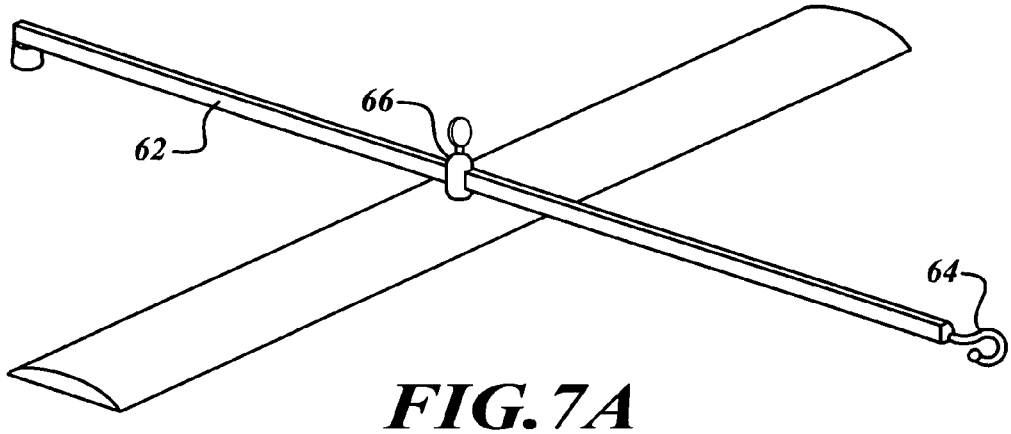
FIG. 7A is a detail view of the anchor base of the FIG. 1A embodiment with the cross member deployed.
Figure 7B:
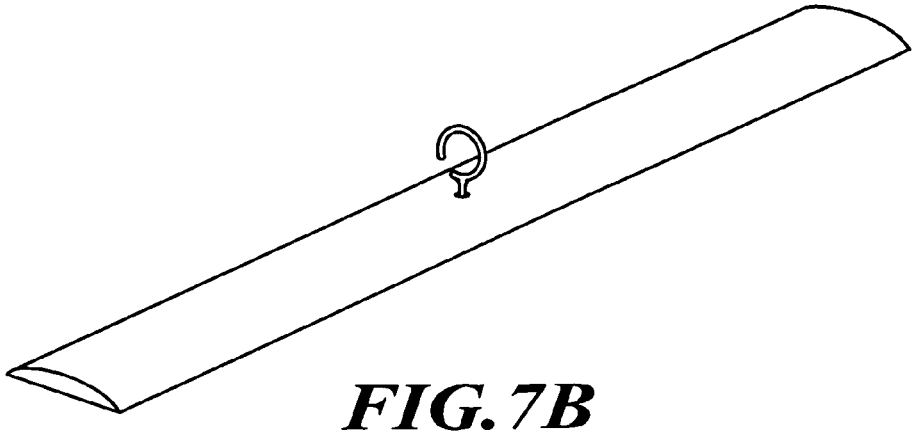
FIG. 7B is a detail view of an alternate embodiment of the anchor base.

FIG. 7A shows the anchor base 12 of the first embodiment. The user stands with both feet on the anchor base 12, using his or her weight to hold the exerciser in place throughout the exercise. (Alternatively, of course, the user could place a heavy weight on the anchor base to provide the necessary normal force or could fasten the anchor base to the ground or floor.) The base is preferably cambered as in the illustration in order to support the weight but also to bite into the floor (typically a rubber mat, rug, or carpet) so as to secure the base from sliding. The anchor base 12 also may be grooved on the top and coated on the underside with a non-slip material so as to provide traction. In the preferred embodiment, cross member 62 can be used to space the resistance band (which will be attached to hook 64 generally located at the distal end of the cross member 62) further away from the user and to further stabilize the anchor base when in use. Because the cross member 62 pivots on the pin 66, the cross member can swivel to align with the anchor base for storage. FIG. 7B shows an anchor base for the alternate version which comprises the hook at the center for attaching the resistance band(s). After the user has selected and installed the desired resistance band(s), he stands on the anchor base and grips the handlebars of the handlebar assembly. The user then bends in the appropriate way to apply tension to the resistance band(s).

What is claimed is:

1. An abdominal exerciser comprising:

an elongate stem member having an extendable tail portion with an attachment area at the top end of said member and a hook at the bottom end of said extendable portion wherein said elongate stem member further comprises an ergonomically curved hollow stem and said extendable portion comprises a tail extension slidable within said stem and wherein said tail extension is adjusted relative to said stem with a stop and a finger pull that cooperate with slots defined by said tail;

a handlebar assembly attached to said top end attachment area, said handlebar assembly being adjustable relative to said stem member such that the included angle can be modified and wherein said handlebar assembly further comprises a neck pad; and an anchor base attached to said bottom end hook via resistance bands.

2. The abdominal exerciser of claim 1 wherein said anchor base further comprises a cross member pivotally attached thereto for attaching said resistance bands.

3. The abdominal exerciser of claim 2 wherein said cross member comprises a hook at the distal end for attaching said resistance bands.

4. An abdominal exerciser comprising:

a stem having an upper end and a lower end;

a tail extension slidably attached to said lower end of said stem and having a bottom end;

a neck pad attached to said upper end of said stem;

a handlebar assembly also attached to said upper end of said stem;

at least one resistance band removably attached to said bottom end of said tail extension; and an anchor base removably attached to said at least one resistance band.

5. The abdominal exerciser of claim 4 wherein said stem is a generally elongate hollow cylinder having an upper end and a lower end, said upper end defining a neck pad attachment area, and said lower end adapted to receive the tail extension.

6. The abdominal exerciser of claim 4 wherein said tail extension is slidably inserted into said lower end of said stem and selectively fastened into position using a collar with a pull pin.

7. The abdominal exerciser of claim 4 wherein said neck pad is attached to said upper end of said stem with an attachment brace.

8. The abdominal exerciser of claim 4 wherein said handlebar assembly mounts adjustably to said upper end of said stem using a gear tooth collar and a handlebar clampdown assembly.

9. The abdominal exerciser of claim 4 wherein said handlebar assembly further comprises hand grips.

10. The abdominal exerciser of claim 4 wherein said at least one resistance band includes attachment rings at either end and provides variable resistance.

11. The abdominal exerciser of claim 4 wherein said anchor base is grooved on the upperside and coated on the underside with a non-slip material.

12. A method of exercising a user's abdominal muscles using an abdominal exerciser having an anchor base upon which the user stands connected via at least one resistance band and a stem/tail assembly to a neck pad which rests on the user's neck and shoulders and also comprising a handlebar assembly attached at an upper end to said stem/tail assembly, such method comprising the steps of:

selecting and installing the desired at least one resistance band;

standing on the anchor base and gripping said handlebar assembly; and bending in an appropriate way to apply tension to said at least one resistance band.

13. The method of claim 12 further including the step of adjusting the included angle of said handlebar assembly relative to said stem/tail assembly.

14. The method of claim 12 wherein the user bends forward to condition abdominal muscles.

15. The method of claim 12 wherein said user twists to the left or right to condition oblique muscles.

16. The method of claim 12 wherein said user bends backward to condition muscles of the users lower back.

* * * * *